US008238564B2

(12) United States Patent
Revit et al.

(10) Patent No.: US 8,238,564 B2
(45) Date of Patent: Aug. 7, 2012

(54) SOUND REPRODUCTION METHOD AND APPARATUS FOR ASSESSING REAL-WORLD PERFORMANCE OF HEARING AND HEARING AIDS

(76) Inventors: Lawrence J. Revit, West Windsor, VT (US); Robert B. Schulein, Evanston, IL (US)

( * ) Notice: Subject to any disclaimer, the term of this patent is extended or adjusted under 35 U.S.C. 154(b) by 1364 days.

(21) Appl. No.: 11/854,258

(22) Filed: Sep. 12, 2007

(65) Prior Publication Data

US 2007/0297626 A1 Dec. 27, 2007

Related U.S. Application Data

(62) Division of application No. 09/803,683, filed on Mar. 9, 2001, now Pat. No. 7,340,062.

(60) Provisional application No. 60/189,293, filed on Mar. 14, 2000.

(51) Int. Cl.
*H04R 29/00* (2006.01)
*H04R 5/02* (2006.01)

(52) U.S. Cl. ..... 381/60; 381/300; 381/307; 381/26

(58) Field of Classification Search ..... 381/60, 381/300, 17, 18, 307, 26; 73/585; 600/559
See application file for complete search history.

(56) References Cited

U.S. PATENT DOCUMENTS

| | | | | |
|---|---|---|---|---|
| 4,759,070 | A * | 7/1988 | Voroba et al. | 381/60 |
| 5,260,920 | A * | 11/1993 | Ide et al. | 369/5 |
| 6,067,360 | A * | 5/2000 | Kasai et al. | 381/1 |
| 6,366,679 | B1 * | 4/2002 | Steffen et al. | 381/356 |
| 6,845,163 | B1 * | 1/2005 | Johnston et al. | 381/92 |
| 7,340,062 | B2 * | 3/2008 | Revit et al. | 381/60 |

* cited by examiner

*Primary Examiner* — Xu Mei
(74) *Attorney, Agent, or Firm* — McAndrews, Held & Malloy, Ltd.

(57) ABSTRACT

A sound recording and reproduction system for testing hearing and hearing aids is disclosed. Recordings of sound are made in a real word acoustic environment, for example, which are stored as audio signals. In a testing environment, a plurality of loudspeakers is located about a listening position where a test subject is placed during a testing procedure. The plurality of loudspeakers receive at least a portion of the plurality of the stored audio signals, and convert those audio signals received into a combination of sounds that produce, at the listening position, acoustic elements of the real world acoustic environment where the recordings were made. The system enables, in a clinical or other test setting, the evaluation of hearing and/or hearing aid performance as if in a real world environment.

20 Claims, 11 Drawing Sheets

FIGURE-OF-8 POLAR CHARACTERISTICS OF B-FORMAT MICROPHONE OUTPUTS

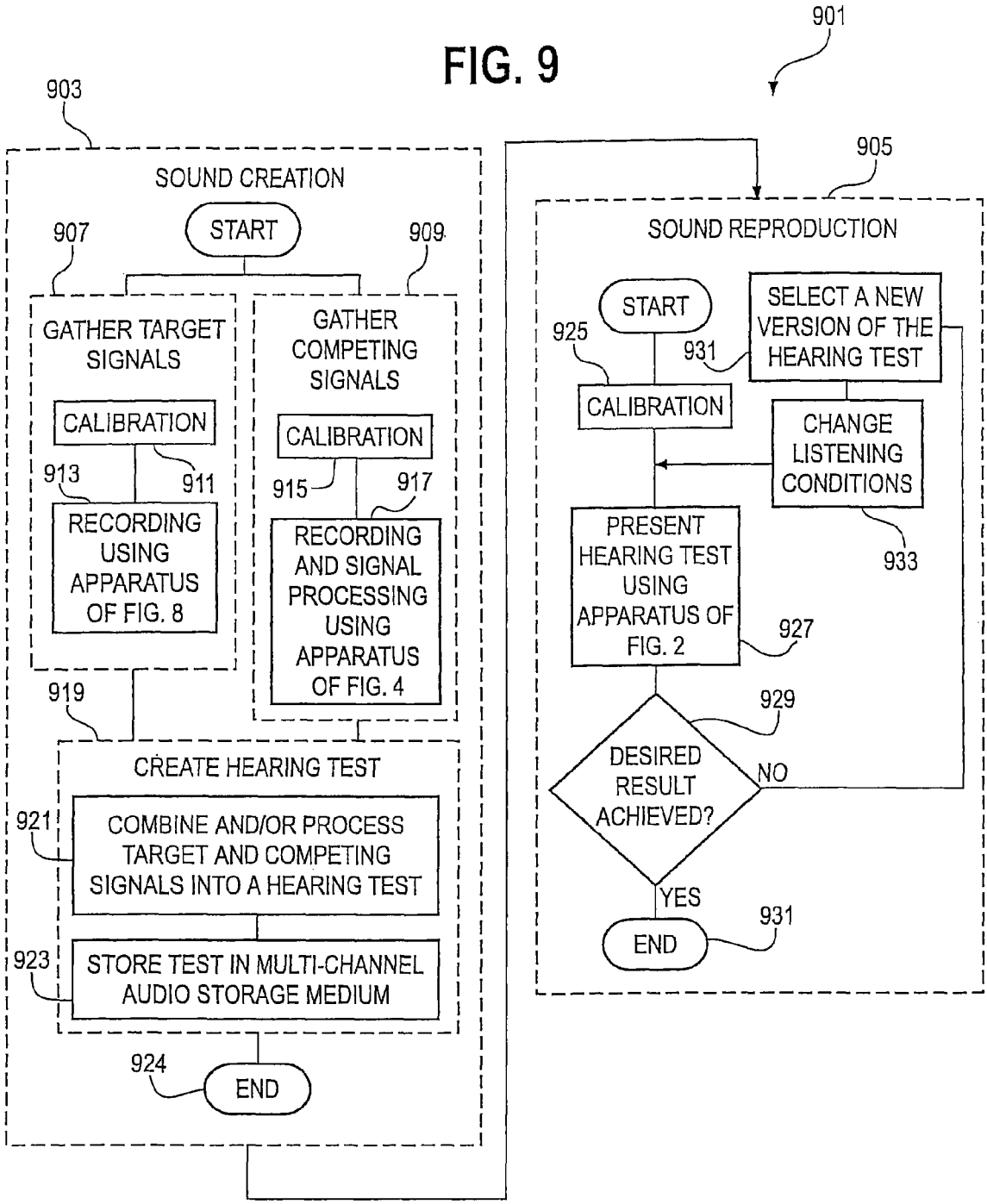
FIG. 9
901
903
SOUND CREATION
START
907
909
GATHER TARGET SIGNALS
CALIBRATION
913
911
RECORDING USING APPARATUS OF FIG. 8
GATHER COMPETING SIGNALS
CALIBRATION
915
917
RECORDING AND SIGNAL PROCESSING USING APPARATUS OF FIG. 4
919
CREATE HEARING TEST
921
COMBINE AND/OR PROCESS TARGET AND COMPETING SIGNALS INTO A HEARING TEST
923
STORE TEST IN MULTI-CHANNEL AUDIO STORAGE MEDIUM
924
END
905
SOUND REPRODUCTION
START
925
CALIBRATION
931
SELECT A NEW VERSION OF THE HEARING TEST
CHANGE LISTENING CONDITIONS
933
PRESENT HEARING TEST USING APPARATUS OF FIG. 2
927
929
DESIRED RESULT ACHIEVED?
NO
YES
END
931

SOUND REPRODUCTION METHOD AND APPARATUS FOR ASSESSING REAL-WORLD PERFORMANCE OF HEARING AND HEARING AIDS

RELATED APPLICATIONS

The present application is a division of U.S. patent application Ser. No. 09/803,683, entitled "Sound Reproduction Method and Apparatus for Assessing Real-World Performance of Hearing and Hearing Aids," which was filed Mar. 9, 2001 and makes reference to, and claims priority to and the benefit of, U.S. Provisional Application Ser. No. 60/189,293, filed Mar. 14, 2000. The present application incorporates both of the aforementioned applications by reference in their entireties.

BACKGROUND OF THE INVENTION

Dispensers of hearing aids often fail to complete the sale of a hearing aid to a patient or client who could otherwise benefit from using one. One possible reason for such failure is that a patient or client may be unwilling from the start to purchase a hearing aid because he has no realistic way of knowing in advance how a hearing aid can help alleviate his hearing difficulties. Another possible reason is that a patient or client who actually does purchase a hearing aid may return it when his unrealistically high expectations were not met by the hearing aid in the outside world. Thus, a method and apparatus for demonstrating to patients and clients the potential benefits of hearing aids under acoustic real-world conditions is desirable.

In the last decade, microphones and signal processing used in hearing aids have become more and more sophisticated. Today, many models of hearing aids provide much more for the listener than simply the amplification of sound. In particular, directional microphones in hearing aids provide listeners with demonstrable improvements in speech intelligibility in noise. However, the United States Food and Drug Administration (FDA) has recently issued guidelines to the hearing aid industry, calling for dual-site, refereed clinical studies to substantiate claims made in hearing aid advertising beyond, simply, that a hearing aid amplifies sound. Such studies are to include evaluations of real-world subjective performance, such as by self-reporting by hearing aid users. But, at best, self-reporting procedures are time consuming and of limited reliability. A fast, reliable, objective apparatus and method of evaluating subjective, real-world performance of hearing aids is also therefore desirable.

Attempts to provide such a desirable apparatus and method, however, have failed to adequately address the above problems. For example, standardized bench tests of hearing aid performance have been developed providing industrial quality-control procedures, as mandated by the FDA (ANSI S3.22). However, the American National Standards Institute (ANSI) working group responsible for such tests (S3/WG48) has recognized that the current standards do not address the need to give clinicians ways to predict the efficacy of hearing aids in real use, even on a broad, general basis (i.e., for the average user). The ANSI working group is therefore developing standardized bench tests toward helping to fill that need. But, in any form, bench tests of a hearing aid can at best describe its average performance, that is, for the average hearing-aid user. Clinicians also seek, however, a fast, objective, and reliable method of showing that hearing aid products are effective for their clients on an individual basis. Thus, an objective method and apparatus for testing the real-world performance of hearing aids for individual users in a clinical setting is desirable.

In addition, an important aspect of hearing loss is one's ability to understand speech in the presence of masking noises and reverberation. Currently available clinical methods of assessing speech intelligibility in noise and reverberation generally rely on signal delivery systems that use either one or two earphones, or else one or two sound-field loudspeakers. Such systems may not present listening conditions to the ear which adequately exercise the auditory system in ways indicative of real-world function. Specifically, earphones, even if two are used, do not permit the listener to use hearing aids during testing. Nor do earphone tests account for the auditory effects of listening in a sound field. And one- or two-loudspeaker sound-field systems cannot surround the listener with background noise, as is the case in the real world, while presenting speech intelligibility tests.

Moreover, a principal goal of recent developments in hearing aid design has been to improve a hearing-impaired listener's ability to understand speech in noisy environments. Through the early 1990s, common experimental designs testing speech intelligibility in noise used either one loudspeaker for both noise and target signals, or else used one loudspeaker for the noise and another for the target signal. With such simple experimental setups, the background noise presented through the one loudspeaker may have consisted of sounds representative of real-life environments. However, the auditory experience of listening to such a one-loudspeaker presentation of background noise is far from that of actually being in a real-life noisy environment. Sound coming from one loudspeaker simply does not surround the listener as does sound in real-life noisy situations. Additionally, with such a presentation of background noise from only one loudspeaker, the binaural auditory system of a listener may not experience the same level or type of difficulty as it would in real-world noisy environments. In some cases, a subject's understanding of target speech tests could be accomplished more easily in the experimental environment than in real-life environments. In other cases, because the spatial and directional information of real-life acoustic environments is not present in the experimental environment (background noise does not surround the listener), a subject cannot fully use his natural signal-extraction mechanisms that rely on spatial and directional cues, thus making speech understanding more difficult than in real life. In short, single-or dual-loudspeaker signal-delivery systems used in research on speech intelligibility in noise do not provide an adequate representation of real-world adverse listening conditions, in part because the background noise does not surround the listener.

Within the last few years, an important development in hearing-aid design has been the addition of directional microphones. A directional microphone helps the listener understand speech in noise, because unwanted sounds coming from directions surrounding the listener are attenuated as compared to sound coming from directly in front of the listener. Therefore, the listener, when wearing a hearing aid equipped with a directional microphone, needs only to look at a talker to improve the signal-to-noise ratio (SNR) of the targeted speech signal produced by the hearing aid. An improved SNR translates into improved speech intelligibility for the signals received by a listener, as documented by many published scientific studies.

Attempts have been made to quantify improvements in speech intelligibility in noise for listeners wearing directional hearing aids. Sound systems used in such attempts have consisted of many problematic designs. One such system uses a single loudspeaker placed behind the listener to present background noise, while the targeted speech is presented in front of the listener. Such a system does not adequately document real-life performance, because, with directional microphones, the improvement in SNR observed when noise comes from a single, rear loudspeaker is not the same as when noise comes from directions surrounding the listener.

Multiple loudspeaker systems have thus been used to present background noise from directions surrounding the listener for the purpose of testing the performance of directional hearing aids. Such systems, however, have presented signals that are, for many reasons, not life-like.

Specifically, one such system presents uncorrelated Gaussian noise (spectrally shaped white noise) from several loudspeakers placed around the perimeter of the listening room. This system is successful at creating a purely diffuse sound field. But Gaussian noise (the same kind of noise as found between stations on an FM radio) is not indicative of real-world environments, because most real-life sound fields combine diffuse signals with direct signals.

Another such multiple loudspeaker system presents pre-recorded voices from multiple loudspeakers surrounding the listener. In this system, the presented, pre-recorded voices are recorded using microphones placed close to the talkers' mouths, in such a way as to remove from the recordings any acoustical conditions present in the recording environment. In other words, the recordings contained only the voices, and not the acoustical qualities of the recording environment. There are several problems with this system.

First, because the voices are recorded of talkers talking individually, usually while reading from a text, the presented speech sounds are not real conversations, and thus do not have many of the acoustical qualities that are present in real-life conversational speech.

Second because the loudspeakers are placed at a considerable distance from the listener (perhaps even beyond the "critical distance" of the listening room), the acoustical conditions in the listening room exert a substantial influence on the sounds received by the listener. Thus, even if representations of the acoustical conditions of the recording environment are present in the recordings of the individual voices presented over multiple loudspeakers, the acoustical conditions of the room used for playback override the acoustical representations of the recording environment, because the loudspeakers are too far away from the listener for the direct sound from the recordings to predominate.

And third, the signal from each loudspeaker is completely uncorrelated with the signals from each other loudspeaker, and therefore the total signal is not life-like. In real-life listening environments, which contain the acoustical qualities of the listening environment, the signals received by the listener from one direction are partially correlated with signals received from each other direction.

In any event, clinicians involved in the diagnosis and treatment of central auditory processing disorders have reported that these standard methods for testing the hearing abilities of patients who complain of having difficulty hearing in certain acoustic environments, do not always provide adequate information about the problems underlying the complaints. The reason for this may be that a patient's problems exist only under certain acoustic conditions encountered outside those afforded by currently available clinical tests. Thus, a method and apparatus that effectively places the patient under the same adverse listening conditions which are known to occur in the real world, and can therefore excite the reported problem, is therefore desirable.

It may be suggested that a system similar to entertainment "surround sound" systems may be used to address many of the above-mentioned problems. However, such entertainment systems are not suited for use in hearing and hearing aid assessment for many reasons. For example, in entertainment audio systems, the loudspeakers are located substantially distant from the listener, at or near the perimeter of a listening area that is accessible to multiple listeners. As with previous multiple-loudspeaker systems used in hearing and hearing-aid assessment, signals received by listeners from such entertainment audio systems contain a substantial contribution of the acoustical qualities of the listening environment. In any system that delivers signals containing the acoustical qualities of the listening environment as such, a given recording sounds somewhat different in different listening environments and has different acoustical qualities in each listening environment. Such systems, therefore, do not enable the desired standardization for hearing and hearing aid assessment.

In addition, entertainment audio systems are designed so that background noises presented to the listener enhance or support the reception of an entertainment event, such as a primary audio signal or a visual picture. In the real world, however, background noises presented to the listener do not enhance or support the reception of a primary audio signal or a visual picture. Instead, background noises disrupt or compete with the reception of such primary stimuli, resulting in conditions under which the reception of such primary stimuli breaks down. It is these real-world conditions that are desirable for hearing and hearing aid assessment.

It is therefore an object of the current invention to provide a sound reproduction method and apparatus which simulates or reproduces life-like acoustic environments for the purposes of testing or demonstrating, in a laboratory, a clinic, a dispensary or the like, the performance of hearing and/or hearing aids under conditions of real function.

SUMMARY OF THE INVENTION

Aspects of the present invention may be found in multichannel sound reproduction system for testing hearing and hearing aids. The system comprises an audio source that transmits audio signals to a multiple loudspeakers that are placed about a listening position where a test subject rests. The multiple loudspeakers receive at least a portion of the audio signals and convert the audio signals received into a combination of sounds that produce at the listening position acoustic elements of either a real or an imaginary acoustic environment for the test subject to experience. The multiple loudspeakers may, for example, be placed and oriented arbitrarily about the listening position, such that they face different directions relative to each other and relative to the listening position.

In one embodiment for testing speech intelligibility in noise, for example, the audio signals represent a target speech signal and multiple interfering noise signals. The target speech signal may emanate from a loudspeaker located front and center of the listening position (i.e., facing the test subject), while the multiple interfering noise signals may emanate from some combination of the remainder of the loudspeakers surrounding the listening position.

Before being fed to the loudspeakers, the audio signals may first be processed by a test administrator using a signal processing system, such as a mixer or audiometer system, for example. This enables the test administrator to control the presentation level of both the target speech signal and the multiple interfering noise signals.

In one embodiment of the system, the loudspeakers are placed at locations that are approximately equidistant from and facing the center of the listening position. In this embodiment, the audio signals may represent recordings made by multiple microphones that are placed at locations that are approximately equidistant from a recording position located in a real world environment. Specifically, during recording, the microphones are placed at locations relative to the recording position that correspond to the locations of the plurality of loudspeakers relative to the listening position, except that the microphones face away from the center of the recording position. Thus, the sounds representative of the real world environment are recorded and may be reproduced at the listening position, so that the test subject may experience a simulation of the real world environment in a clinical setting, for example, where the listening position is located.

In one embodiment, some combination of the loudspeakers may be used to generate sound that appears to, but does not, emanate from one or more of the loudspeakers. This creates a more realistic acoustic environment at the listening position.

The multi-channel sound reproduction system may comprise, for example, another configuration where multiple loudspeakers are located at approximately ear level of the test subject in the listening position. Four loudspeakers may be used and located at each of four corners relative to the listening position. Another loudspeaker is located at approximately ear level and at front and center of the test subject in the listening position. Still a further loudspeaker is located at an overhead center position above the test subject in the listening position. The overhead loudspeaker may receive a time-offset or delayed sum of the audio signals that are fed to the other loudspeakers, providing a realistic reproduction of the recorded real world environment.

These and other advantages and novel features of the present invention, as well as details of an illustrated embodiment thereof, will be more fully understood from the following description and drawings.

BRIEF DESCRIPTION OF SEVERAL VIEWS OF THE DRAWINGS

FIG. 9 is a flow diagram of one possible use of the system (s) of the present invention, from sound gathering to reproduction.

DETAILED DESCRIPTION OF THE INVENTION

Figure 1A:
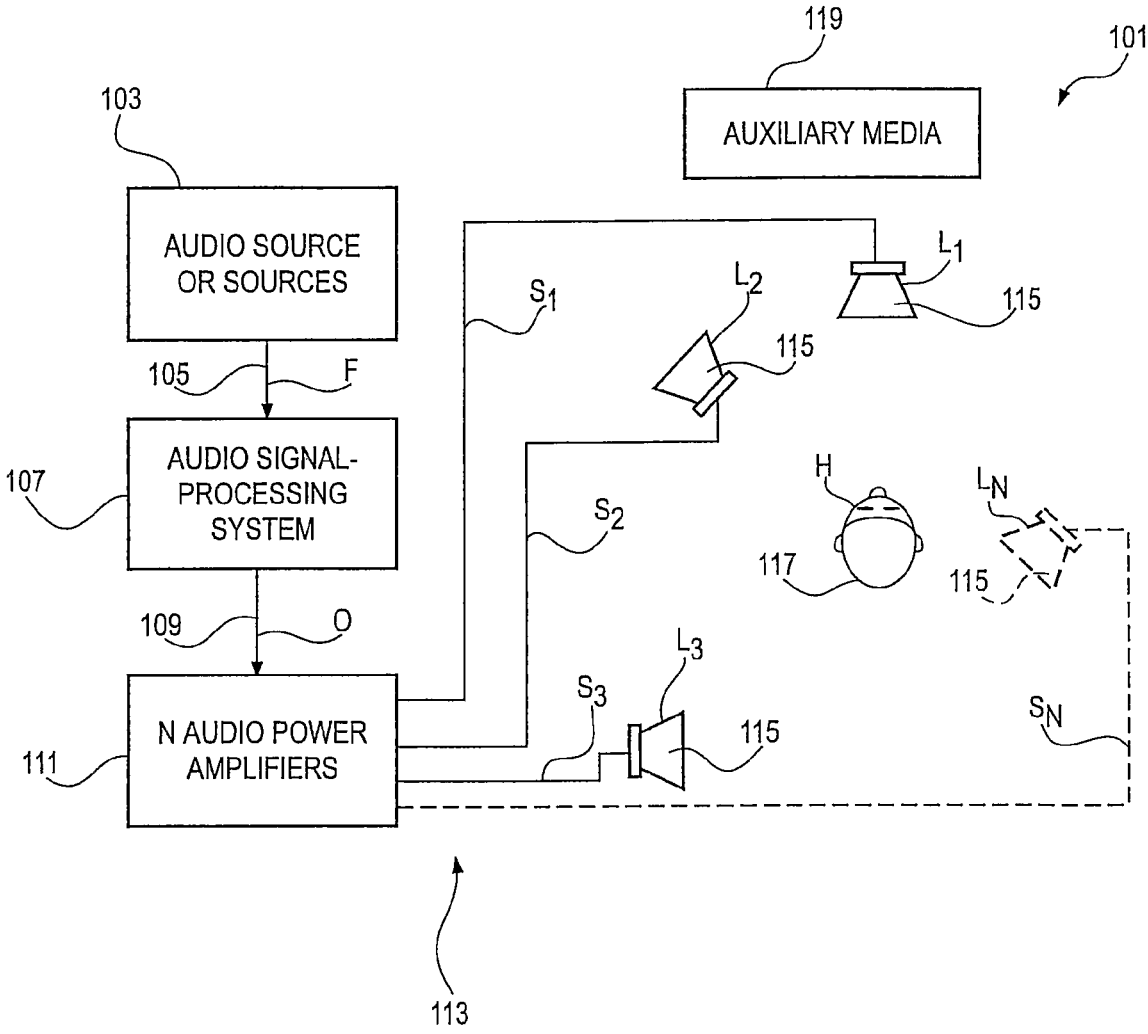
FIG. 1*a* is a diagram of one embodiment of an overall system for assessing real world performance of hearing and hearing aids in accordance with the present invention.

FIG. 1*a* is a diagram of one embodiment of an overall system for assessing real world performance of hearing and hearing aids in accordance with the present invention. In a system 101, a combination of one or more audio sources 103 supplies a set of one or more first audio input signals (F) 105 to an audio signal-processing system 107. The audio sources 103 may comprise, for example, single- or multiple-track audio media players or room reverberation synthesizers. The audio signal-processing system 107 may comprise, for example, an audio combining network, a signal time-delay device, or other signal-processing devices, and a set of amplitude controls. In one embodiment, the audio signal processing system 107 comprises an audiometer and level-dependent attenuators. The audio signal-processing system 107 processes the audio input signals 105 into a respective plurality of output signals (O) 109, which are transmitted to a respective plurality of audio power amplifiers 111. The plurality of audio power amplifiers 111, in turn, deliver a plurality amplified signals 113 (e.g., $S_1$, $S_1$, . . . $S_N$) to a plurality of loudspeakers 115 (e.g., $L_1$, L1, . . . $L_N$), which are both placed and oriented arbitrarily around a listener (H) 117 located at a listening position (or "sweetspot"). The plurality of loudspeakers 115 emit a combination of sounds that serve to produce, at the listening position, acoustic elements of a real or imaginary acoustic environment.

In addition, one or more auxiliary media 119, such as a video display system, may also be placed within view of the listening position to enhance the experience of the listener 117. Video images displayed may assist in providing a real world "being there" feeling for the listener. Further, video images of a talker's face may, during a speech intelligibility test, add a speech reading (lip reading) component to the test.

Figure 1B:
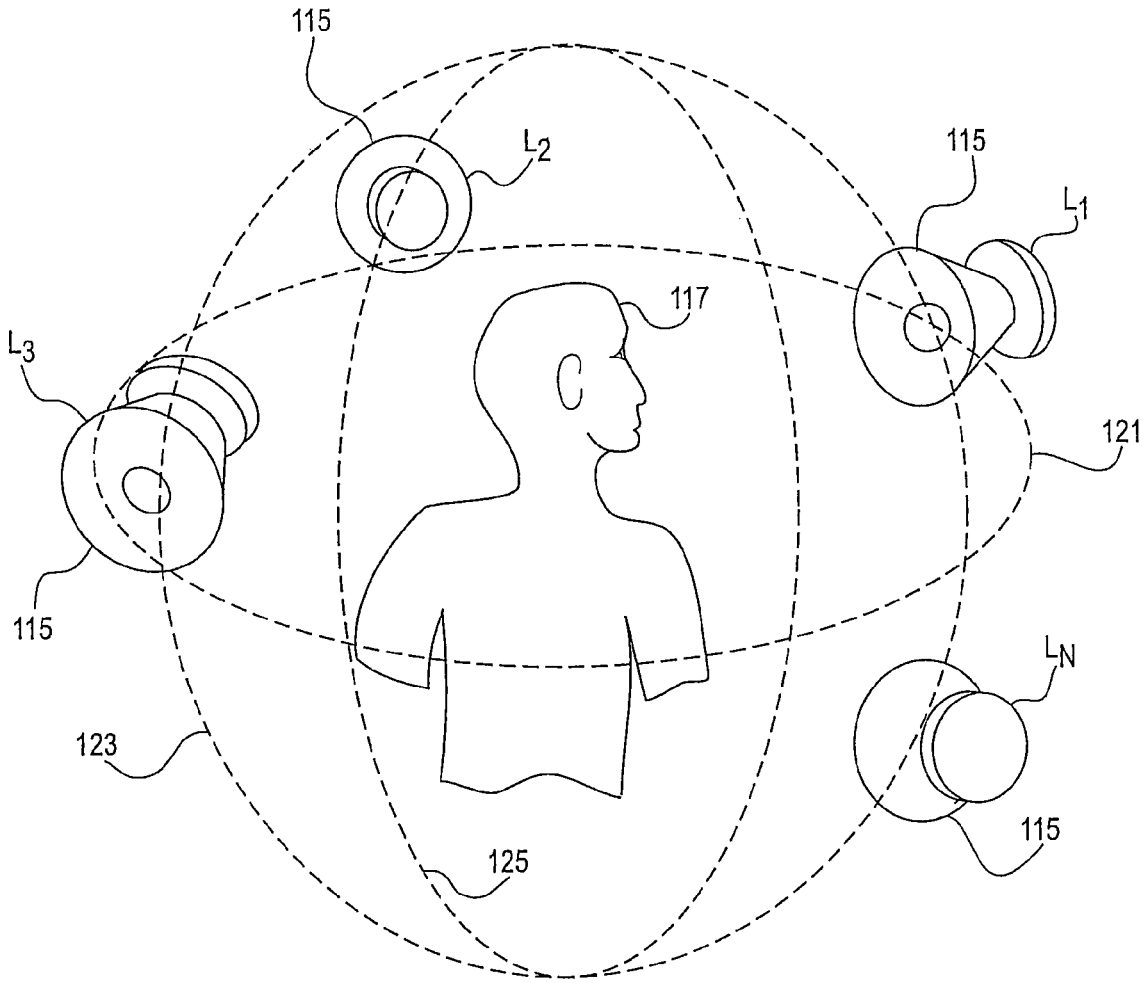
FIG. 1*b* is one perspective view of the system of FIG. 1*a*, illustrating one possible arrangement of loudspeakers about listener in a listening position.

FIG. 1*b* is one perspective view of the system of FIG. 1*a*, illustrating one possible arrangement of the loudspeakers 115 about the listener 117 in the listening position. As can be seen and as mentioned above, the loudspeakers 115 are both placed and oriented arbitrarily around the listener 117. In other words, the loudspeakers face different directions relative to each other and relative to the listening position, and may be located at varying heights relative to the listening position. In FIG. 1*b*, for example, loudspeakers 115 designated as L2 and LN are located in different horizontal planes relative to horizontal plane 121, in which loudspeakers 115 designated as L1 and L3 are generally located. In addition, all of the loudspeakers 115 are oriented differently (i.e., face different directions)

within their respective horizontal planes, and are oriented at different angles within respective vertical planes (e.g., vertical planes 123, 125).

In any case, it should be understood that the number, location and orientations of the loudspeakers 115 in FIGS. 1*a* and 1*b* are exemplary only, that many other quantities, locations and orientations of loudspeakers are possible and contemplated by the present invention.

Figure 1C:
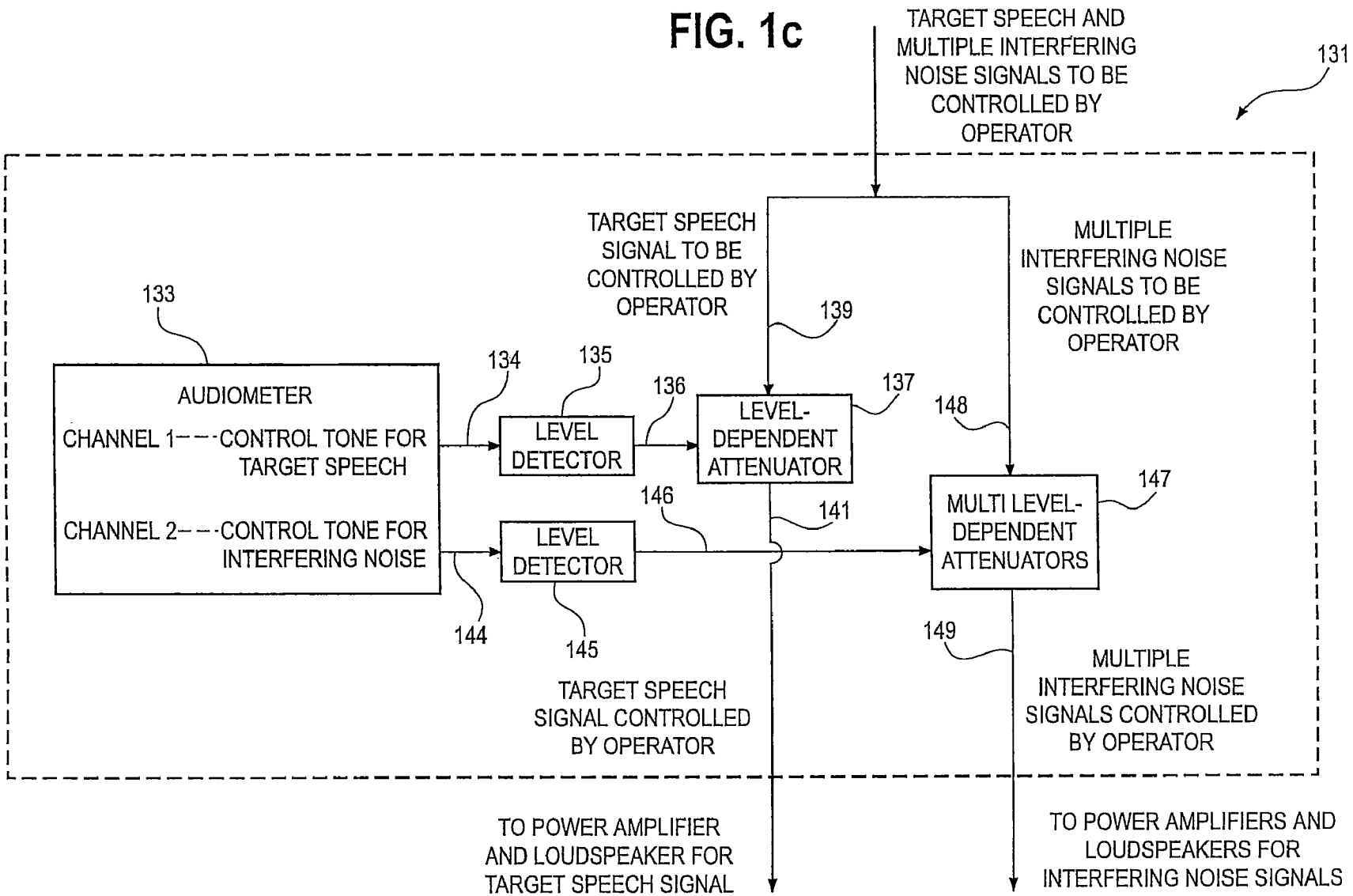
FIG. 1*c* is a block diagram of one embodiment of an audio signal-processing system that, according to FIG. 1*a*, receives audio sources and feeds audio power amplifiers according to the present invention.

FIG. 1*c* is a block diagram of one embodiment of the audio signal-processing system 107 of FIG. 1*a*. In the embodiment of FIG. 1*c*, audio signal processing is performed via an audiometer-controlled system 131, which comprises a conventional clinical audiometer 133. One channel of the audiometer 133 controls the level of the target speech signal, while the other channel of the audiometer 133 controls the levels of multiple interfering noise signals.

Each channel of the audiometer 133 is set to produce a sinusoidal tone (such as 1 kHz). An output 134 of channel 1 of the audiometer 133, which will control the amplitude of a target speech signal 139, feeds a level detector 135 (such as an rms detector, for example). The level detector 135 outputs a control signal 136 (such as a dc voltage, for example) which is fed to a control input of a level-dependent attenuator 137 (such as a voltage-controlled amplifier, for example). The target speech signal 139 is fed to a signal input of the level-dependent attenuator 137. An output 141 of the level-dependent attenuator, representing a controlled target speech signal, feeds a power amplifier and loudspeaker (both not shown in FIG. 1*c*) for the target speech signal.

An output 144 of channel 2 of the audiometer 133, which will control the amplitude of the multiple interfering noise signals, feeds a level detector 145 (such as an rms detector, for example). The level detector 145 outputs a control signal 146 (such as a dc voltage, for example) which is fed simultaneously to control inputs of multiple level-dependent attenuators 147 (such as voltage-controlled amplifiers, for example). Multiple interfering noise signals 148 are fed to signal inputs of the multiple level-dependent attenuators 147. Outputs 149 of the multiple level-dependent attenuators 147, representing controlled multiple interfering noise signals, feed power amplifiers and loudspeakers (both not shown in FIG. 1*c*) for the multiple interfering noise signals.

With the arrangement of FIG. 1*c*, an operator controls the presentation level of the target speech signal by manipulating the channel-1 attenuator on the audiometer 133. Such manipulation changes the level of the control output 134 for target speech, which in turn causes analogous changes in the control signal 136 output by the level detector 135, which in turn causes analogous changes in the target speech signal 141 output from the level-dependent attenuator 137.

The operator controls the presentation level of the multiple interfering noise signals by manipulating the channel-2 attenuator on the audiometer. Such manipulation changes the level of the control output signal 144 for interfering noise, which in turn causes analogous changes in the control signal output 146 by the level detector 145, which in turn causes simultaneous analogous changes in the multiple interfering noise signals 149 output from the multiple level-dependent attenuators 147.

Figure 1D:
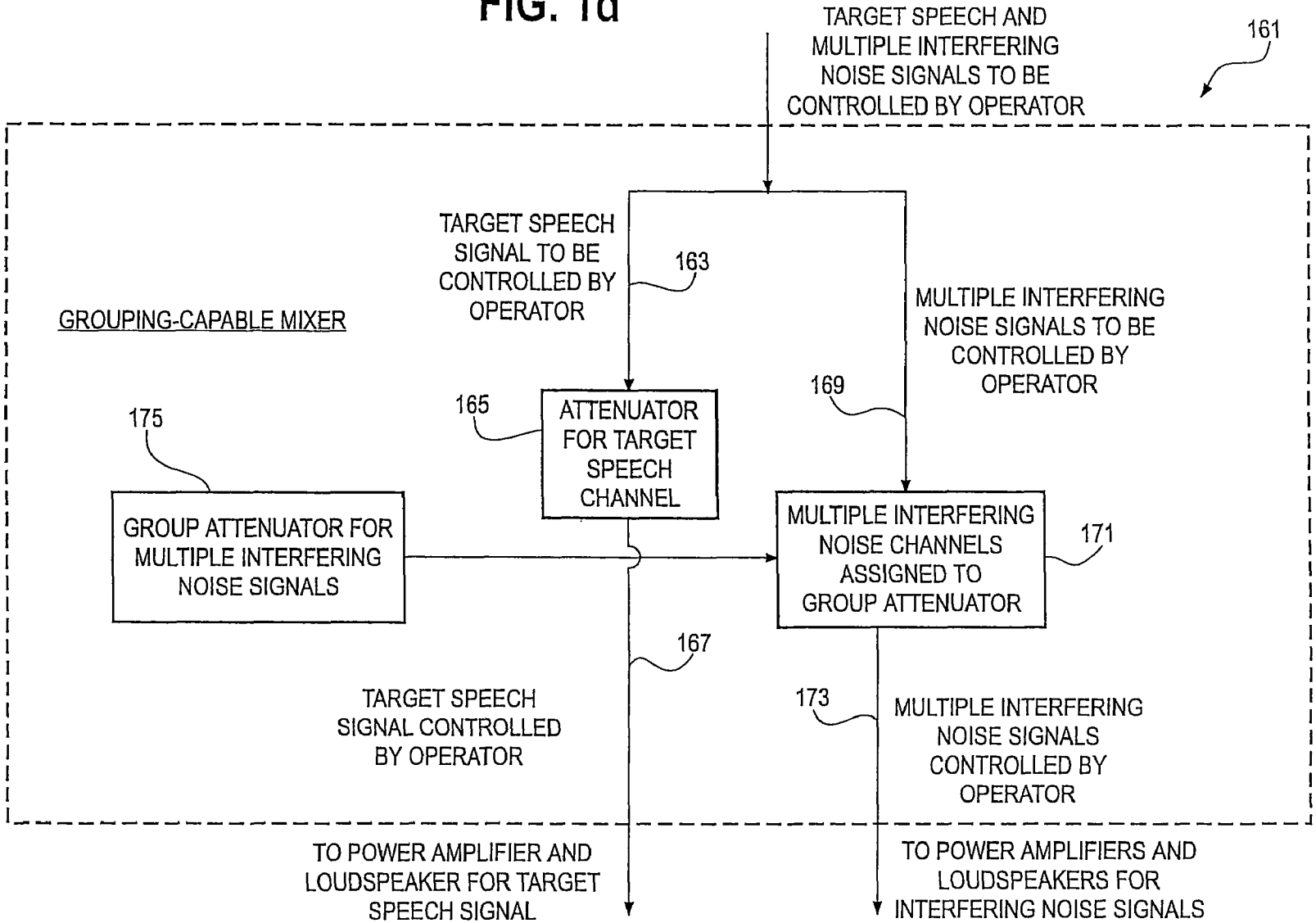
FIG. 1*d* is a block diagram of another embodiment of an audio signal-processing system that, according to FIG. 1*a*, receives audio sources and feeds audio power amplifiers according to the present invention.

FIG. 1*d* is a block diagram of another embodiment of the audio signal processing system 107 of FIG. 1*a*. In the embodiment of FIG. 1*d*, audio signal processing is performed via a grouping capable mixer 161. One channel of the mixer 161 controls the level of the target speech signal, while a channel group of the mixer 161 controls the levels of multiple interfering noise signals.

A target speech signal 163 is fed to an input of one channel of the mixer 161. An output 167 of the channel, representing a controlled target speech signal, feeds a power amplifier and loudspeaker (both not shown in FIG. 1*d*) for the target speech signal. Multiple interfering noise signals 169 are fed to the signal inputs of channels 171 which are assigned to a group within the mixer 161. Outputs 173 of channels 171 represent controlled multiple interfering noise signals, which feed multiple power amplifiers and loudspeakers (both not shown in FIG. 1*d*) for the multiple interfering noise signals.

With the arrangement of FIG. 1*d*, an operator controls the presentation level of the target speech signal by manipulating attenuator 165 for the channel containing the target speech signal. The operator controls the presentation level of the multiple interfering noise signals 169 by manipulating a group attenuator 175 for the channels 171 containing the multiple interfering noise signals.

Figure 2:
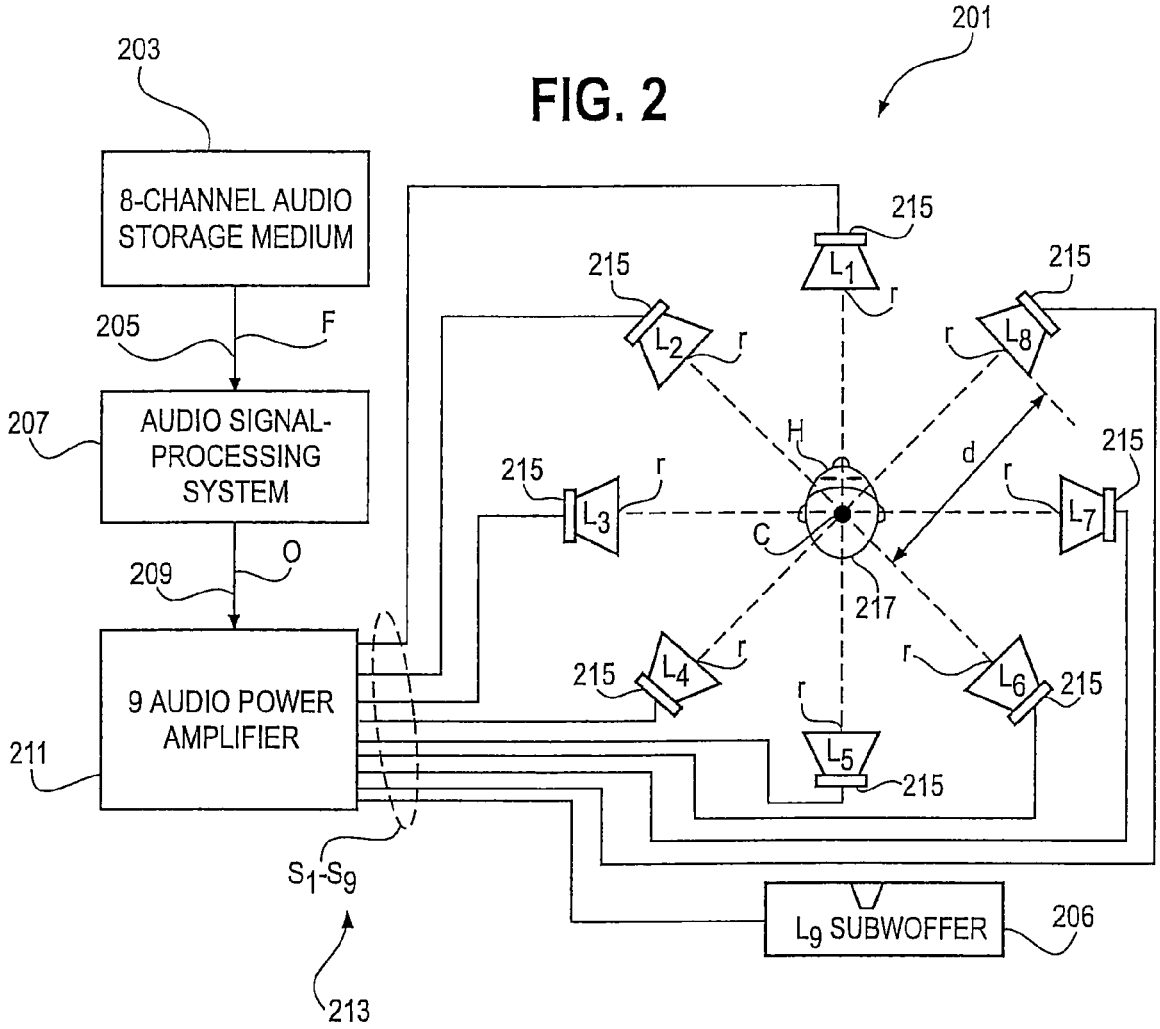
FIG. 2 is a block diagram of one embodiment of a multi-channel sound-field reproduction and simulation system built in accordance with the present invention.

FIG. 2 is a block diagram of one embodiment of a multichannel sound-field reproduction and simulation system built in accordance with the present invention. In a system 201, an audio source 203, which may comprise, for example, an eight-channel audio medium player such as a Tascam Model DA-38, provides eight discrete first audio signals (F) 205 from a digital recording on, for example, a Hi8Model tape cassette. The eight first audio signals 205 are received from the audio source 203 by an audio signal processing system 207. The audio signal processing system 207 may comprise, for example, individual level and tone controls for each audio recording contained in the 8-channel audio storage medium, a summing network and a low-pass filter for supplying the signal that will be used by a subwoofer 206. In one embodiment, the audio signal processing system 207 comprises a device, such as shown in FIGS. 1*c* or 1*d*, for example, which groups all the interfering noise signals into one control and the target speech signal to another control, so that the operator can control the signal-to-noise ratio of target and multiple noise signals with one or two controls. The audio signal processing system 207 may also pass, separately and unfiltered, the eight audio signals 205 directly to eight ear-level channels. In other words, output signals (O) 209 from the audio signal processing system 207 may comprise, for example, eight discrete level- and tone-adjusted versions of the first signals 205, plus a ninth output which is a level-adjusted, low-pass filtered combination of the signals from all the other channels. In one embodiment, each other channel supplies an equal proportion of the combination. The output signals (O) 209 from the audio signal processing system are received by the nine audio power amplifiers 211, which deliver amplified output signals 213 ($S_1$-$S_9$) to loudspeakers 215 ($L_1$-$L_9$). The loudspeakers 215, in turn, deliver sound to a listening position occupied by a listener (H) 217.

In the embodiment of FIG. 2, the loudspeakers 215 comprise eight ear-level loudspeakers ($L_1$-$L_8$) placed in a circle, so that the loudspeakers 215 are equidistant from each other and from the head of the listener 217. The loudspeakers 215 are each placed such that a distance (d) exists between a center of the listener's head (C) and a reference point (r) of each loudspeaker, and such that each is pointing toward the center (C) of the listener's head. The distance d may be, for example approximately 24 inches. As explained more completely below with respect to FIG. 4, the positions of the eight loudspeakers 215 correspond to the orientations and placements of eight microphones (not shown in FIG. 2) used during recording, except that the microphones are pointed in the opposite direction relative to the loudspeakers. In other words, during recording, the eight microphones are directed away from, instead of toward, the listening position.

More particularly, seven of the amplified signals 213 (i.e., $S_2$-$S_8$), resulting in sound delivered to the listener 217 via loudspeakers 215 (i.e., $L_2$-$L_8$), are comprised of, for example, seven separate microphone recordings of a real acoustic environment that is being reproduced. Additionally, two of the amplified signals 213 (i.e., $S_2$ and $S_8$) also comprise equal proportions of an eighth microphone recording of the real acoustic environment that is being reproduced. This proportional distribution between two loudspeakers creates a "phantom" acoustic image of the recording that appears to emanate from loudspeaker L.sub.1, even though it does not. The amplified signal S.sub.1, delivered to the listener 217 via loudspeaker L.sub.1 consists of a separate recording of a single voice reciting sentences that comprise a test of speech intelligibility.

Finally, a ninth loudspeaker ($L_9$) is positioned in FIG. 2, and comprises the subwoofer 206, which is placed, for example, on the floor near the listening position. The purpose of the subwoofer 206, which receives a high-pass filtered signal ($S_9$), is to extend the low-frequency range of the total acoustic signal delivered to the listening position beyond that which the eight ear-level loudspeakers 215 are capable of producing.

In preparation for operation of the system 201 of FIG. 2, the levels of setup signals recorded on the eight-channel storage medium may be adjusted individually to produce a predetermined sound-pressure level at the calibration point (C). The calibration point (C) may be, for example, approximately six inches above the geometric center of the top of the listener's head. Such calibration enables the operator to present the reproduced sound field at the same or different overall level compared to what existed in the original environment being reproduced. Additionally, pre-determined speech-to-noise ratios (SNRs) can be achieved for hearing tests by adjusting the relative level for signal $S_1$, compared to the other signals. These adjustments in SNRs can be embodied in the recording contained in the storage medium or can be altered during playback, such as with the audio signal-processing systems depicted in FIGS. 1*c* and 1*d*, for example.

Figure 3:
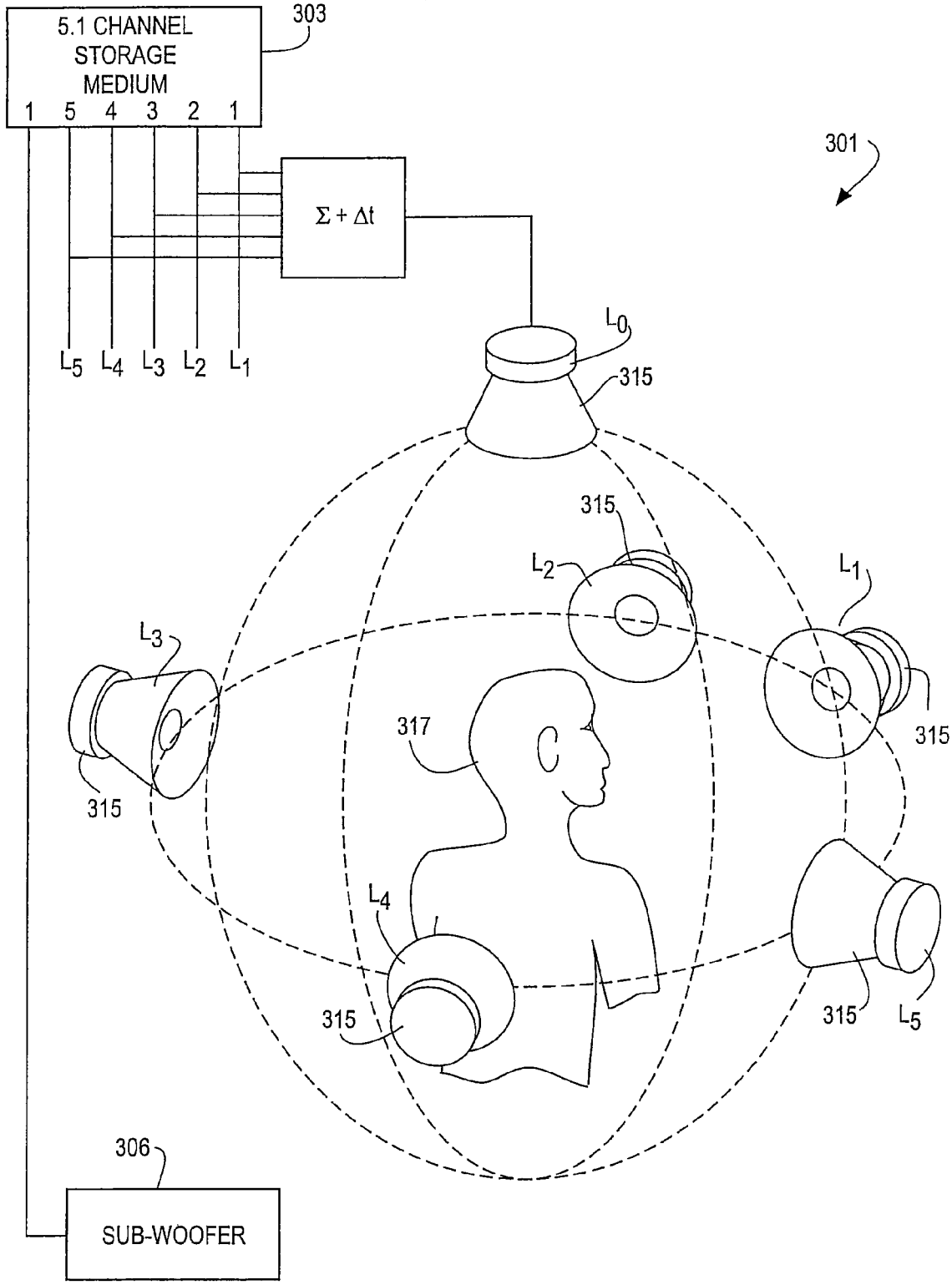
FIG. 3 is a block diagram of another embodiment of a multi-channel sound-field reproduction and simulation system according to the present invention.

In a slightly altered version of the above embodiment, the signal $S_1$, which consists of speech sentence materials, can be replaced by a signal (not shown) from a separate storage medium (not shown). FIG. 3 is a block diagram of another embodiment of a multi-channel sound-field reproduction and simulation system according to the present invention. A system 301 comprises seven loudspeaker/amplifier combinations. More specifically, four loudspeakers 315 (i.e., $L_2$-$L_5$) are located at ear level of a listener 317 and at each of four corners relative to the listening position. Another single loudspeaker 315 (i.e., $L_1$) is located at ear level and at front and center of the listener 317. A further single loudspeaker 315 (i.e., $L_0$) is located at an overhead center position. Finally, a subwoofer 306 is located on the floor near the listening position.

The system 301 also comprises a 5.1-channel audio medium 303 (such as a DVD) as an audio source (see FIG. 7 below for conversion from 8-channel recording to 5.1 channels). In operation, the medium 303 transmits, via channels 1-5, competing signals to the corner loudspeakers 315. Conversion from 8-channel to 5.1-channel medium allows for images appearing discretely from each corner, and for phantom images (referenced above) from front- and back-center, and left-and right-side positions. Each competing signal, real and phantom, may have a unique time or phase offset, relative to the original recordings of the environment. The time or phase offset serves to decorrelate each signal from the others, and therefore makes the acoustic images more distinct.

In addition, the medium 303 transmits, via a low-frequency-effects ("0.1") channel, a signal comprised of a low-pass filtered sum of all corner and phantom images contained within the other 5 channels to the subwoofer 306.

The medium 303 also transmits a time-offset or delayed sum of the five main channels (designated '"Sigma'+ 'Delta't", in FIG. 3), containing an equal contribution from each channel, to the overhead loudspeaker ($L_0$). This time-delayed combination of all other sounds performs at least three functions. First, it provides a diffuse like auditory impression, since it is difficult to distinguish an overhead source from a diffuse source, as long as the head does not tilt (horizontal rotation of a listener's head does not affect the response obtained from the overhead source). Second, without using a time-delayed mix to an overhead loudspeaker, the de-correlated ear-level sources do not blend, but instead sound like a series of point sources distributed around a circle. Adding the delayed (e.g., approximately 10 milliseconds or so) overhead source gives an impression of blending the point sources into an overall three-dimensional space of sound. And third, from a practical standpoint, the time-delayed combination of all other sounds provides a fixed source of sounds coming from ninety degrees relative to the listener, independently of head rotation in the horizontal plane. For testing directional microphones, using the overhead source affords possible advantages over not using it in the embodiment of FIG. 3, which does not have side loudspeakers (i.e., has no real sources at ninety-degrees relative to the front).

Finally, referring again to FIG. 3, the medium 303 transmits a target signal, such as speech-intelligibility test materials, to the front-center loudspeaker, as with the embodiment of FIG. 2.

Figure 4:
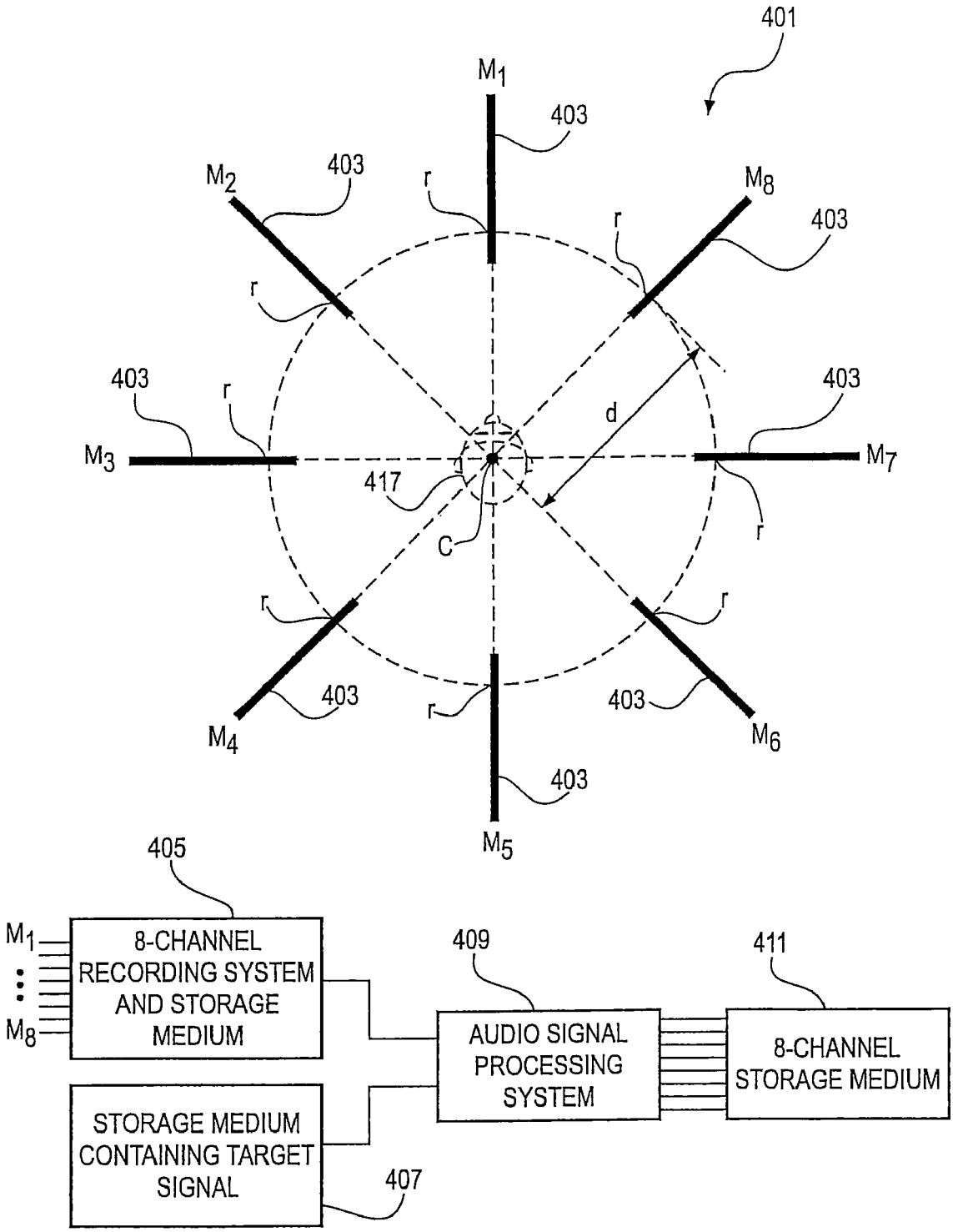
FIG. 4 shows one embodiment of a sound gathering, signal processing and storage medium system that supplies the audio sources of the systems of FIGS. 1-3.

FIG. 4 shows one embodiment of a sound gathering, signal processing and storage medium system 401 that supplies the audio sources of the systems of FIGS. 1-3. In an adverse acoustic environment to be reproduced, such as a restaurant, eight long interference-tube type microphones or "shotgun microphones" 403 (i.e., $M_1$-$M_8$), such as, for example, the Sennheiser Model MKH-70, are placed in a circle around the listening position desired to be reproduced in the systems of FIGS. 1-3. In an alternative embodiment, the microphones 403 may be conventional first-order directional microphones, instead of shotgun microphones. With first-order directional microphones, however, the images reproduced are not as distinct as those reproduced with shotgun microphones.

Referring again to FIG. 4, each microphone 403 has an acoustic reference point (r) located at, for example the diaphragm of the microphone 403. These reference points correspond to the location of the reference points of the loudspeakers in the simulation and reproduction system, such as embodied in FIGS. 1-3. As in FIG. 2, for example, the reference points (r) are placed at a specified distance (d) from the center (C) of the head of a listener 417. Again this distance may be, for example, approximately 24 inches.

During operation, the output from each shotgun microphone 403 is recorded and stored in a respective channel of an 8-channel storage medium 405. These signals are processed, along with a target signal stored in a storage medium 407, by an audio signal processing system 409. The resulting signals are then stored in an 8-channel storage medium 411, which is used by the systems of FIGS. 1-3, for example.

The system 401 of FIG. 4 may be calibrated as follows. First the gains of the recording system (the signal chains from the microphones to the storage medium) are set before or after the time of recording (at a quiet time when environmental sounds will not affect the calibration). Next, a loudspeaker (not shown) is placed in front of each microphone (one at a time) at a distance of at least 2 feet outward from the reference point of the microphone, to avoid proximity effect. A calibration signal (pink noise) is played over the loudspeaker to create a known sound pressure level as measured by a sound-level meter (not shown) at the calibration point (C). This calibration signal is then recorded onto the storage medium for each microphone.

Figure 5A:
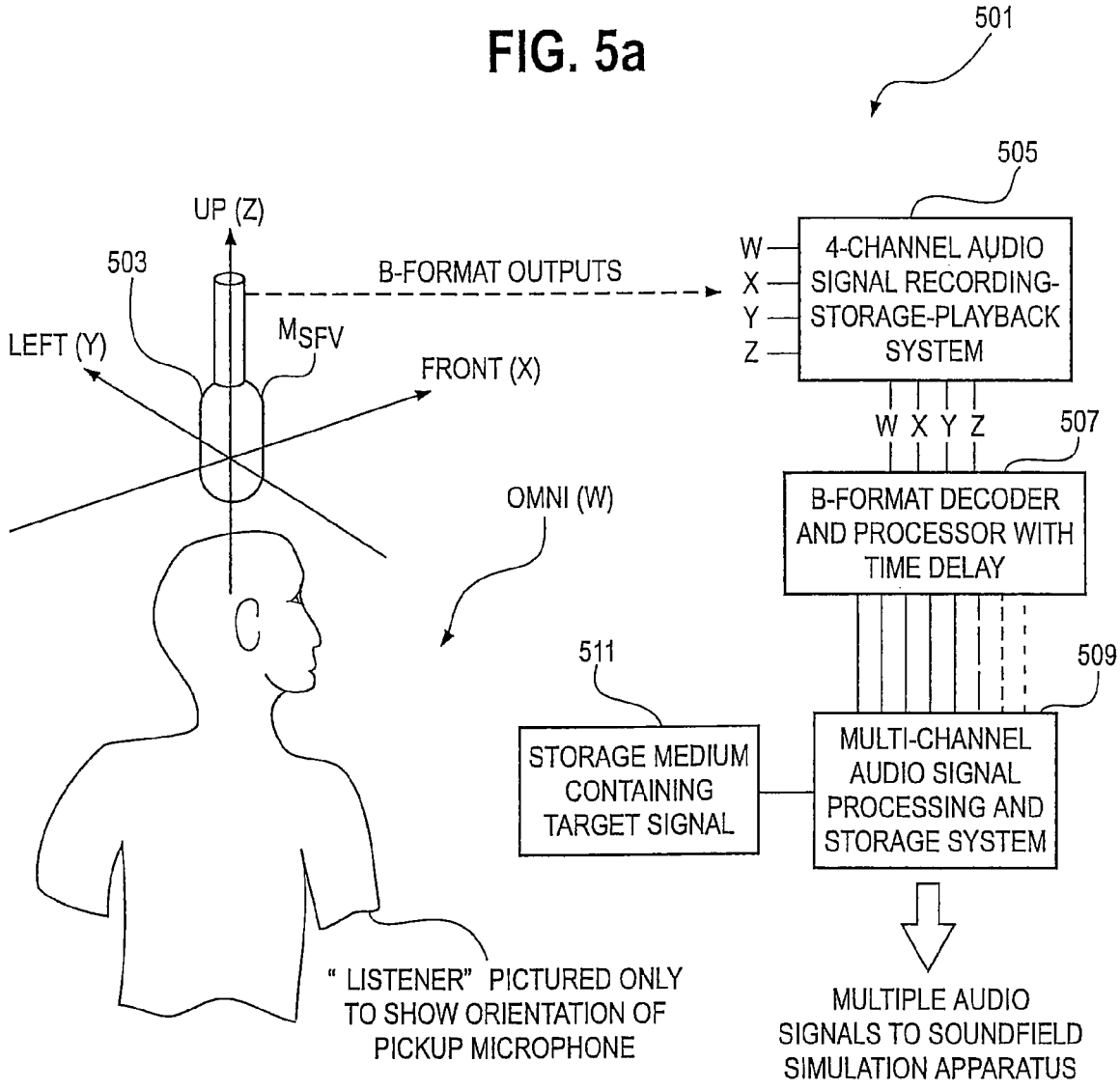
FIG. 5*a* shows a sound gathering, signal processing and storage system that uses only a single microphone, and therefore requires much less space than the system shown in FIG. 4.
Figure 5B:
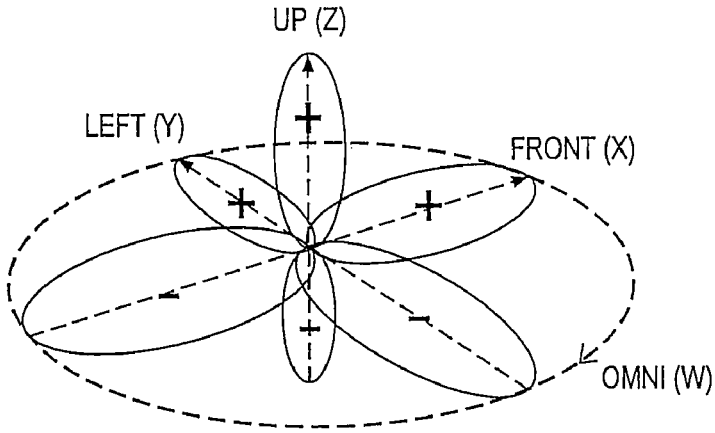
FIG. 5*b* illustrates the microphone pickup patterns for the microphone in the system of FIG. 5*a*.

FIG. 5*a* shows a sound gathering, signal processing and storage system that uses only a single microphone, and therefore requires much less space than the system shown in FIG. 4. Such a system 501 as shown in FIG. 5*a* lends itself well to recording sounds in small spaces, such as, for example, an interior an automobile. This system uses a three-dimensional microphone system known as "B-format" or "Ambisonics." A multi-microphone system 503, such as, for example, the SoundField Mk-V system (M.sub.SFV), is placed at a listening position in an environment to be recorded. The microphone system 503 contains a signal processor (not shown) that combines signals from each microphone element into three figure-of-eight patterns, whose axes (X, Y, and Z) are indicated by the arrows facing to the front, left, and upward in FIG. 5*a*, respectively. A fourth pattern (W) is omnidirectional. The microphone pickup patterns are also represented in FIG. 5*b*. It should be understood that the omnidirectional pattern is spherical, even though it is represented in FIGS. 5*a* and 5*b* by a single curved arrow in the horizontal plane. In other words, the omnidirectional pattern (W) picks up evenly from every direction in three-dimensional space around the microphone. Similarly, the bi-directional patterns (x, y, and z) are three-dimensional as well, as if rotated about their axes, even though only two-dimensional patterns are depicted in the figure.

In the system of FIG. 5*a*, signals from each of the B-format patterns (W, X, Y, and Z) are recorded in a 4-channel medium 505. Later processing converts the 4-channel signal into first-order directional microphone patterns facing in any direction in three-dimensional space around where the microphone was located during recording. In addition, the system implements a time and/or phase offset between each signal. As mentioned above, first-order directional microphone signals yield less distinct images than those of shotgun microphones. However, as discussed above with respect to the embodiment of FIG. 3, the use of a time-offset between each signal causes the images to become more distinct. A phase offset can have a similar effect. Processing and time- and/or phase offsets are performed by a B-format decoder and processor 507. The time-delayed or phase-shifted versions of the original recording are then combined in a multi-channel medium 509 with a target signal stored in a storage medium 511, to generate the audio sources for the simulation and reproduction systems of FIGS. 1-3, for example.

Figure 6:
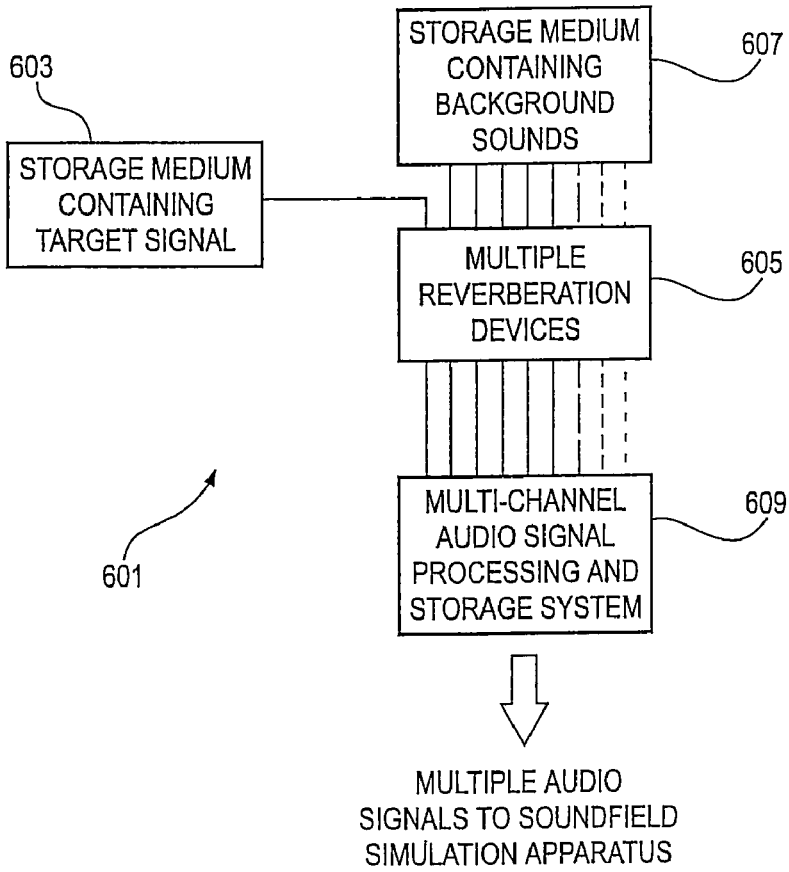
FIG. 6 shows an embodiment of a sound gathering and processing method that may be applied to either of the embodiments found in FIGS. 3 and 4, for example.

FIG. 6 shows an embodiment of a sound gathering and processing method that may be applied to either of the embodiments found in FIGS. 3 and 4, for example. In the embodiments discussed above, microphones are used to create a multi-track recording of some kind of background noise (such as in a restaurant or a car) as a competing signal to be combined with a target signal. In the embodiment of FIG. 6, the competing signal may instead be primarily comprised of a reverberated version of the target signal itself. Reverberation provides the most disruptive kind of competing signal, because the competition is similar to the target signal itself. In real life, meeting halls and places of worship having considerable empty spaces are two examples where reverberation is substantial. In the embodiment of FIG. 6, reverberated version of a target signal may be stored, along with the target signal, in a multi-channel storage medium. Alternatively, the reverberation may be created in real-time by signal-processing devices, with the target signal comprising the only recorded signal. For example, a single track plays target sentences to a front-center loudspeaker. These signals are then transmitted simultaneously to multiple reverberation devices (such as, for example, the Lexicon Model 960L), which in turn transmit reverberated versions of the target signal to multiple loudspeakers.

In the system 601 specifically shown in FIG. 6, a pre-stored target signal from storage medium 603 feeds a multi-channel reverberation system 605. Background sounds from a storage medium 607 may also be added to the input to the reverberation system 605, if desired. An output of the reverberation system 605 feeds a multi-channel audio signal processing and storage system 609, which provides the signal sources for the simulation and reproduction systems of FIGS. 3 and 4, for example.

Figure 7:
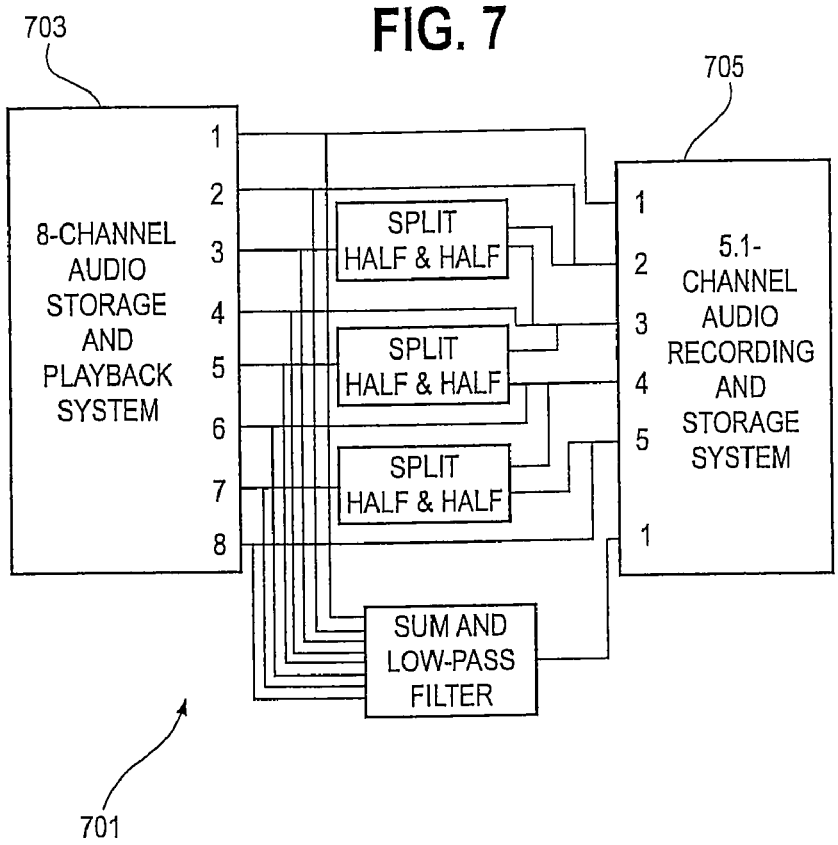
FIG. 7 shows a system for converting an 8-channel recording of competing and target signals for use with a 5.1-channel system.

FIG. 7 shows a system for converting an 8-channel recording of competing and target signals for use with a 5.1-channel system (having five full-bandwidth channels and one low-frequency-effects channel). Such a system 701 is used to create media that provide audio sources for the embodiment of FIG. 3, for example. A target signal from channel 1 of an 8-channel system 703 is recorded directly to channel 1 of a 5.1 channel system 705. Similarly, competing signals from channels 2, 4, 6, and 8 of the 8-channel system 703 are recorded directly to channels 2, 3, 4, and 5, respectively, of the 5.1-channel system 705. To create phantom images between the corner loudspeakers in the embodiment of FIG. 3, signals from channels 3, 5, and 7 of the 8-channel system 703 are first split in half. The halves are then distributed to each of two adjacent channels of the 5.1-channel system 705, namely, channels 2 and 3, 3 and 4, and 4 and 5, respectively. Additionally, an equal proportion of the signals from each channel of the 8-channel system 703 are summed and low-pass filtered, and the result becomes a low-frequency-effects (0.1) signal recorded on the 5.1-channel medium 705.

Figure 8:
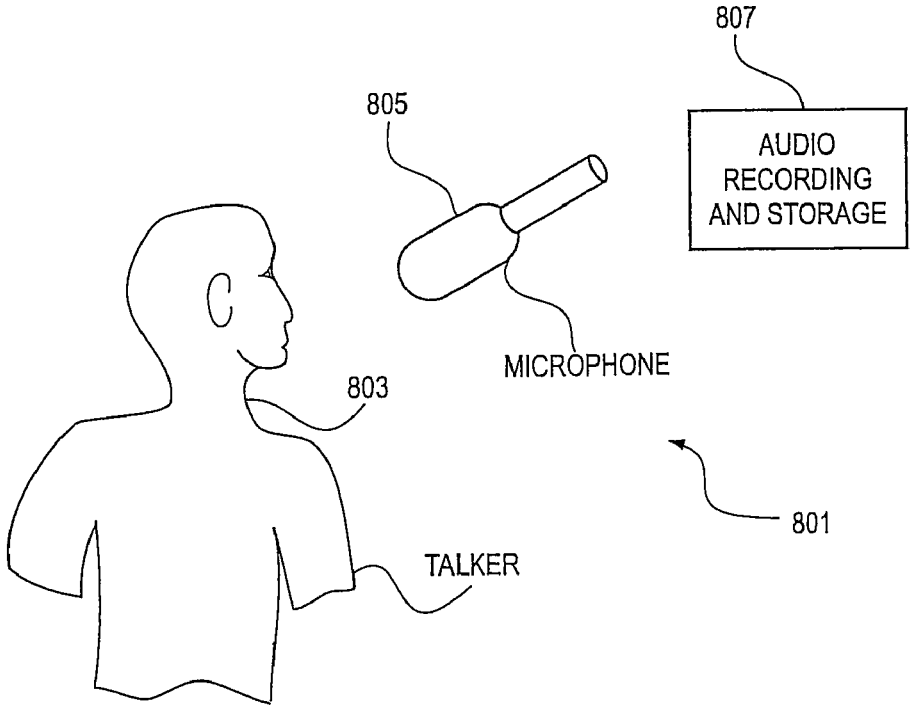
FIG. 8 shows one embodiment of a system for recording a target speech signal.

FIG. 8 shows one embodiment of a system 801 for recording a target speech signal. A talker 803 recites speech-intelligibility test materials, and a nearby microphone 805 transmits an audio signal of the talker's speech to a recording and storage medium 807. Typically, the microphone 805 is placed in such a manner as to record a fill spectrum of frequencies of the talker's speech, and close enough to the talker to avoid recording any effects that the acoustics of the recording environment may have on the speech being recorded.

Operational Use

The following procedure may be used for testing or demonstrating hearing acuity using the system(s) of this invention. In general, a combination of target signals and competing signals are presented to a listener. A single loudspeaker, or more than one loudspeaker, may present the target signals. Alternatively, speech of a real person talking near the listener may be used to present "live," target signals. The competing signals may be presented by all of the loudspeakers surrounding the listener, or by a subset of the loudspeakers. At any given moment, the target signals or the competing signals may or may not be present. Other signals, such as visual enhancements, may or may not be presented over an auxiliary medium, such as a visual display.

In a hearing test, some aspect of either the target signals or the competing signals is presented, or else an ongoing presentation is varied, and the listener either indicates a response, or, if the hearing test is given only for demonstration purposes, the listener may simply observe differences in perception. The system(s) of the present invention may vary the target or competing signals to which the listener responds.

Alternatively variation may occur in some other way, such as, for example, by changing the hearing aid(s) worn by the listener or by changing the setting(s) of hearing aid(s) worn by the listener. A tester may score responses by the listener or, if the hearing test is given only for demonstration purposes, the listener's own observations (e.g., what he or she hears) may comprise the results of the test.

One example of such a hearing test comprises quantifying the ability of a listener to understand speech in background noise. In this example, competing signals may be, for example, life-like reproductions of the sounds of a noisy restaurant, and target signals may be, for example, a list of test sentences. During a test, the test sentences are presented to the listener while the competing noise is also presented to the listener, and the listener is asked to repeat the test sentences. The tester keeps score by marking how many words were repeated correctly by the listener.

In addition, the relative sound amplitudes of the target and competing signals may be varied, to produce variations in the percentage of words repeated correctly by the listener. For example, the tester may initially set the amplitude of the competing signals at a low level, and the amplitude of the target signal at a moderate level. With these initial settings, where the signal-to-noise ratio (SNR) (or "target-to-competition" ratio) is high, the listener may be able to repeat all target words correctly. Then, the tester may raise the amplitude of the competing signal between each time a test sentence or group of sentences is given, while leaving the amplitude of the target signal relatively constant or vice versa. This process is repeated until the listener is able to repeat an average of only half the target words correctly, which indicates that the competing signal has disrupted reception by the listener of half the target words. This disruption of speech reception by competing noise is well documented, and is called "masking." The tester then calculates the relative amplitudes of the target and competing signals as the SNR for 50% correct. The test may then be repeated with a change. For example, hearing aids may be placed in the listener's ears, or the setting(s) of previously placed hearing aids may be modified. A specific example of such a test follows, with reference to FIG. 2.

Channel 1 of the storage medium is reserved, in this example, for target speech signals, which are presented over the front-center loudspeaker $L_1$. In an alternate configuration, the target signals are stored on a separate medium. The remaining seven channels of audio stored in the storage medium contain a life-like reproduction of a noisy restaurant to be presented over loudspeakers $L_2$-$L_8$. Channels 2-8 contain front-left, side-left, back-left, back-center, back-right, side-right, and front-right parts of the restaurant reproduction, respectively. The front-center part of the restaurant reproduction is stored as follows: half the front-center part is stored on Channel 2 of the storage medium and half is stored on Channel 8 of the storage medium. Half the front-center image arrives from $L_2$ and half from $L_8$. The complete front-center image appears to be at $L_1$. This front-center image may be referred to as a "phantom image," because it sounds like it is coming from a loudspeaker in the middle, even though no such loudspeaker exists. Such phantom image is used to save the actual front-center loudspeaker $L_1$ exclusively for target signals. The operator may therefore independently vary the target and competing signals using volume controls, without having to use a mixing apparatus.

As described above, an audio signal-processing system transmits each stored audio channel to a corresponding amplifier and loudspeaker. The audio signal processing system also may add (i.e., mix together at equal levels) channels 2-8 (the restaurant channels), low-pass filters the result, and may transmit the filtered signal to a ninth amplifier. The amplified signal may then be transmitted to a subwoofer.

Before a hearing test is administered, playback calibration may be performed in the following way. As discussed above, in making original recordings of competing signals in an environment to be reproduced, calibration signals (such as pink noise) are stored on each channel of a storage medium. These stored calibration signals correspond to a measured sound-pressure level (SPL) at the listening point in the original environment, corresponding to point C in the reproduced environment. This SPL may be called a "calibration SPL." A separate calibration signal is also stored in a similar fashion for the target signal channel.

While reading an SPL indicated by a sound-level meter (SLM) positioned at point C, the operator adjusts the SPL of the calibration signal being reproduced from each channel of the storage medium to produce the calibration SPL at point C. This may be achieved by, for example, adjusting the gain of each corresponding power amplifier. In this way, the operator can achieve, in the reproduction, the exact same SPLs that were present in the original environment. The operator can also alter these SPLs as desired.

A test of speech intelligibility in noise may proceed, for example, as follows. A set of target words and competing noise are presented to a listener at a starting SNR. If the listener repeats all of the target words correctly, the SNR is decreased. If the listener does not repeat all of the target words correctly, the SNR is increased. In either case, a new set of target words is presented at the adjusted SNR. The above is repeated until the SNR is obtained at which the listener is able to repeat only 50% of the target words.

Another example of a hearing test that uses the system(s) of the current invention may be for demonstration purposes only, such as to demonstrate to a listener the benefits of wearing hearing aids or a particular type of hearing aid. In this example, competing signals are presented at moderately loud levels to the listener, such as may be encountered in a noisy restaurant, while the tester (not shown) sits nearby and talks to the listener as if the tester is carrying on a conversation with the listener. In a first phase of the test, the listener is not wearing a hearing aid(s), or is wearing a first type of hearing aid under test. In a second phase of the test, the listener puts on a hearing aid(s), or else changes to another type of hearing aid. The listener may then decide which hearing aid condition provided the best reception of the tester's speech. In a more objective approach, a recording of speech may be substituted for the tester's speech, and may be presented over one or more of the loudspeakers of the apparatus of the current invention.

As another example, the system(s) of the present invention may be used to test signal detection in background noise. In this example, competing signals may be, for example, sounds of a life-like simulation of a noisy restaurant, and target signals may be, for example, test tones. Test tones are intermittently presented to a listener while the competing noise is also presented to the listener, and the listener is asked to indicate when the test tone is present. The tester keeps score by marking how many times the listener correctly identified the presence of the test tones. The tester may vary the relative sound amplitudes of the target and competing signals to produce variations in the percentage of times that the listener is able to correctly identify the presence of test tones. For example, the tester may initially set the amplitude of the competing signals at a low level, and the amplitude of the target signal at a moderate level. With these initial settings, where the signal-to-noise ratio (SNR) (or "target-to-competition" ratio) is high, the listener may be able to correctly identify all test tones. Then, the tester may raise the amplitude of the competing signal each time a test tone is given, while leaving the amplitude of the test tones relatively constant. This process is repeated until the listener is able to correctly identify an average of only half the test tones presented, which indicates that the competing signal has disrupted identification by the listener of half the test tones. The tester then calculates the relative amplitudes of the target and competing signals as the SNR (signal-to-noise ratio) for 50% correct. The test may then be repeated with a change. For example, hearing aids may be placed in the listener's ears, or the setting (s) of previously placed hearing aids may be modified, or some other aspect of the test may be modified.

The following is a calibration procedure that may be used in the embodiments of FIGS. 2 and 4, for example, for sound gathering and reproduction, respectively. This procedure establishes, in the reproduced sound field, the exact same sound levels that were present in the original sound field that was recorded. Similar procedures may be used for this and other embodiments.

With reference to FIG. 4, for example, calibration for sound gathering (recording) may proceed as follow. First, a loudspeaker (not shown) is placed in front of microphone M.sub.1 at a distance of two feet, for example. Next, a sound-level meter (not shown) is placed at point C at the center of the microphone array. While the sound-level meter at point C is being monitored, a calibration signal, such as pink noise, is played over the loudspeaker at a pre-determined sound level (called, for example, the "calibration level") measured at point C. At the same time, a signal (called, for example, the "calibration signal") is recorded from M.sub.1 onto the audio storage medium channel corresponding to M.sub.1. The above is then repeated for each of the microphones. Sound may now be recorded without having to change any of the gain settings between the microphones and the storage medium.

With reference to FIG. 2, for example, calibration for sound reproduction may proceed as follows. The following calibration procedure is based on the assumption that the recording from each microphone of FIG. 4 is played over a respective loudspeaker in FIG. 2, i.e., without using a phantom image for the signal appearing at $L_1$, as described with respect to FIG. 4 above. When using a phantom image as such, the calibration procedure is very similar to the following, but involves minor changes.

First a sound-level meter (not shown) is positioned at the calibration point (C). Next the calibration signal originally from M.sub.1 is played over L.sub.1. The gain of the corresponding audio power amplifier is then adjusted so that the sound level measured at C matches the calibration level achieved during the recording calibration. The above is repeated for each loudspeaker $L_2$-$L_8$. At this point, playing, at the same time, all of the environmental signals corresponding to $M_1$-$M_8$ over loudspeakers $L_1$-$L_8$ achieves the same overall sound level as that which occurred during the recording process. In other words, at the listening position, the reproduced sound field has the same sound level as the original, assuming that all but a negligible portion of the power of the original sound field was picked up in the recording process.

One possible use of the systems of the present invention, from sound gathering to reproduction, is outlined in the flow diagram of FIG. 9. An overall method 901 comprises two stages, a sound creation stage designated by box 903, and a sound reproduction stage designated by box 905. The sound creation stage is started by gathering target signals (block 907) and gathering competing signals (block 909). Gathering target signals may comprise calibration (block 911) as discussed above, and recording (block 913) using the apparatus of FIG. 8, for example. Gathering competing signals may comprise calibration (block 915) as discussed above, and recording and signal processing (block 917) using the system of FIG. 4, for example.

Once the target and competing signals are gathered, a hearing test is created (block 919). This may be achieved by combining and/or processing the target and competing signals (block 921) as discussed above. The hearing test is then stored in a multi-channel storage medium (923). At this point, the sound creation stage (box 903) is complete (block 924).

Next, the sound reproduction stage (box 905) begins. First, the system is calibrated (block 925). The hearing test generated in the sound creation stage is then presented to a user (block 927) using the system of FIG. 2, for example.

If the desired result is achieved by the initial presentation of the test (block 929), the test is complete (block 931). If not, then a new version of the hearing test may be selected (block 931) and/or the listening conditions may be changed (block 933). The hearing test is then re-presented to the listener (block 927). Again, if the desired result is achieved (block 929), the test is complete (block 931). If not, then again a new version of the hearing test may be selected (block 931) and/or the listening conditions may be changed (block 933), and the hearing test is re-represented to the listener (block 927). In any case, the above is repeated until the test produces the desired result (block 931).

The system(s) and method(s) of the present invention provide at least the following advantages:

(1) simulates, in a clinical test space, acoustic conditions that are likely to present difficulties to a hearing aid user in the real world;

(2) provides a fast, reliable and objective means for evaluating subjective, real-world performance of hearing aids;

(3) demonstrates to potential hearing aid users the benefits of hearing aids under acoustic conditions of real-world use;

(4) creates a background sound field that surrounds the listener as in the real-world, to better test a person's abilities to understand speech in noise and reverberation;

(5) provides an improved presentation of real-world adverse listening conditions to identify products that may help a user hear better under acoustically taxing conditions;

(6) presents simulations and reproductions of real-life environments that use real-world sounds combining direct- and diffuse-field elements;

(7) presents recordings of real conversations taking place in real-life environments, which recordings include both environmental sounds and representations of the acoustical conditions or qualities of the environment(s) in which the conversations took place;

(8) provides correlation of signals delivered from different directions;

(9) effectively places a listener under the same adverse listening conditions that are known to occur in the real-world to assist in re-creating hearing problems experienced by the listener under those adverse listening conditions;

(10) presents to a listener the acoustical qualities of the environment that is being reproduced, while greatly reducing the influence of the acoustical qualities of the playback room; and

(11) creates recordings that sound the same and have the same acoustical qualities in every listening environment, thereby enabling standardization of clinical tests.

Many modifications and variations of the present invention are possible in light of the above teachings. Thus, it is to be understood that, within the scope of the appended claims, the invention may be practiced otherwise than as described hereinabove.

The invention claimed is:

1. A method of testing audio capability comprising:

recording sounds of an acoustic environment via a plurality of microphones placed about and facing away from a recording position;

storing the sounds recorded by each of the plurality of microphones as audio signals in at least one audio source;

recording speech;

storing the recorded speech as a target signal in the at least one audio source;

reproducing, from the stored target signal via a target signal loudspeaker, sounds representative of the speech at a listening position; and reproducing, from the stored audio signals via a plurality of audio signal loudspeakers different from the target signal loudspeaker, sounds representative of the acoustic environment at the listening position, wherein the target signal loudspeaker and the plurality of acoustic signal loudspeakers are placed about and facing into the listening position.

2. The method of claim 1, further comprising combining at least a portion of the audio signals and the target signal before reproducing sounds representative of the speech and of the acoustic environment from at least one combined signal loudspeaker at the listening position.

3. The method of claim 1, wherein at least one of the plurality of acoustic signal loudspeakers exclusively reproduces one of the audio signals corresponding to sounds recorded by one of the plurality of microphones.

4. The method of claim 2, wherein the at least one combined signal loudspeaker comprises an overhead loudspeaker.

5. The method of claim 1, wherein the target signal loudspeaker is located at ear level, front and center to the listening position.

6. The method of claim 1, wherein the plurality of audio signal loudspeakers comprises seven loudspeakers, wherein the plurality of loudspeakers and the target signal loudspeaker are approximately equidistant from and facing toward a center at ear-level to the listening position.

7. The method of claim 6, wherein the audio signals comprises eight audio signals.

8. The method of claim 7, wherein the plurality of audio signal loudspeakers each reproduce a different one of seven of the eight audio signals, wherein an eighth audio signal is reproduced in equal proportions at two of the plurality of audio signal loudspeakers.

9. The method of claim 8, wherein the two of the plurality of audio signal loudspeakers reproducing the equal proportions of the eighth audio signal are located nearest the target signal loudspeaker.

10. The method of claim 9, wherein reproduction of the equal proportions of the eighth audio signal between the two of the plurality of audio signal loudspeakers nearest the target signal loudspeaker creates a phantom acoustic image of the eighth audio signal that appears to, but does not, emanate from the target signal loudspeaker.

11. The method of claim 1, wherein the plurality of audio signal loudspeakers comprises four loudspeakers located at ear-level and at each of four corners relative to the listening position.

12. The method of claim 1, comprising a subwoofer configured to receive a high-pass filtered audio signal to extend a low frequency-range of a total acoustic signal reproduced to the listening position.

13. A sound system comprising:

at least one audio source comprising a target signal and a plurality of audio signals;

a listening position at which a hearing or hearing aid test subject is placed; and a target signal loudspeaker and a plurality of audio signal loudspeakers placed about the listening position, the target signal loudspeaker for receiving the target signal from the audio source, the plurality of audio signal loudspeakers for receiving the plurality of audio signals from the audio source, the target loudspeaker generating sound from the target signal, at least two of the plurality of audio signal loudspeakers generating sound from at least a portion of the plurality of audio signals which appears to, but does not, emanate from the target signal loudspeaker.

14. The sound system of claim 13, wherein the at least two of the plurality of audio signal loudspeakers are located nearest the target signal loudspeaker.

15. The sound system of claim 13, comprising a subwoofer configured to receive a high-pass filtered audio signal to extend a low frequency-range of a total acoustic signal reproduced to the listening position.

16. A sound system comprising:

at least one audio source;

a listening position at which a hearing or hearing aid test subject is placed; and eight loudspeakers approximately equidistant from and facing toward a center of the listening position, the eight loudspeakers comprising a target signal loudspeaker and seven audio signal loudspeakers, the target signal loudspeaker for receiving a target signal from the at least one audio source, the seven loudspeakers for receiving audio signals from the at least one audio source, the audio signals being representative of recordings made by eight microphones that are approximately equidistant from and facing away from a center of a recording position, the recording position being located in an environment having sounds desired to be reproduced at the listening position.

17. The sound system of claim 16, wherein a distance between each of the eight loudspeakers and the center of the listening position is approximately the same as a distance between each of the eight microphones and the center of the recording position.

18. The sound system of claim 16, wherein the eight loudspeakers are placed in a circle around the listening position, and wherein the eight microphones are placed in a circle around the recording position.

19. The sound system of claim 16, comprising a subwoofer configured to receive a high-pass filtered audio signal to extend a low frequency-range of a total acoustic signal reproduced to the listening position.

20. The sound system of claim 16, wherein the seven audio signal loudspeakers each reproduce a different one of seven of the eight audio signals being representative of recording made by the eight microphones, wherein an eighth audio signal is reproduced in equal proportions at two of the seven audio signal loudspeakers.

* * * * *